United States Patent [19]

Jeschke

[11] 4,014,259

[45] Mar. 29, 1977

[54] DRIVE FOR MULTICOLOR SHEET-FED ROTARY PRINTING PRESSES WITH TANDEM-MOUNTED PRINTING UNITS

[75] Inventor: Willi Jeschke, Heidelberg-Boxberg, Germany

[73] Assignee: Heidelberger Druckmaschinen Aktiengesellschaft, Heidelberg, Germany

[22] Filed: Aug. 9, 1974

[21] Appl. No.: 496,168

[30] Foreign Application Priority Data

Aug. 9, 1973 Germany ..... 2340343

[52] U.S. Cl. ..... 101/183

[51] Int. Cl.[2] ..... B41F 5/02

[58] Field of Search ..... 74/410, 427; 101/183– 185, 136, 137, 142, 177, 229–231, 216

[56] References Cited

UNITED STATES PATENTS

| | | | |
|---|---|---|---|
| 1,140,369 | 5/1915 | Gale | 74/427 |
| 1,151,762 | 8/1915 | Day | 74/410 |
| 1,409,319 | 3/1922 | Vaughan | 74/410 |
| 1,430,274 | 9/1922 | Alger | 101/181 |
| 1,495,703 | 5/1924 | MacFarland | 74/410 |
| 1,502,175 | 7/1924 | Clapham | 74/410 |
| 1,536,092 | 5/1925 | Guy et al. | 74/410 |
| 1,551,565 | 9/1925 | Hodgkinson | 74/410 |
| 2,115,975 | 5/1938 | Harrold | 101/136 X |
| 2,425,680 | 8/1947 | Kaddeland | 101/184 |
| 2,439,454 | 4/1948 | Crafts | 101/216 |
| 2,439,454 | 4/1948 | Crafts | 101/216 |
| 2,898,851 | 8/1959 | Peyrebrune | 101/231 X |
| 3,007,406 | 11/1961 | Papa et al. | 101/183 |
| 3,221,651 | 12/1965 | Tagliasacchi | 101/183 |
| 3,511,179 | 5/1970 | Breunig | 101/183 |

FOREIGN PATENTS OR APPLICATIONS

| | | | |
|---|---|---|---|
| 967,417 | 8/1964 | United Kingdom | 101/183 |

*Primary Examiner*—J. Reed Fisher
*Attorney, Agent, or Firm*—Herbert L. Lerner

[57] ABSTRACT

Drive for multi-color sheet-fed rotary printing machines with tandem-mounted printing units driven by a closed gear train and including a drive motor is provided with a transmission or drive train driven by the motor and extending parallel to the closed gear train at least two force input locations connecting the closed gear train to the transmission train, n-1 torque limiters, wherein *n* is equal to the number of force input locations, being provided in the transmission train, one of the force input locations being disposed in a path of direct power flow between the motor and the gear train.

2 Claims, 4 Drawing Figures

DRIVE FOR MULTICOLOR SHEET-FED ROTARY PRINTING PRESSES WITH TANDEM-MOUNTED PRINTING UNITS

The invention relates to a drive for multi-color sheet-fed rotary printing machines or presses with tandem-mounted printing units and, more particularly, with such printing machines that are driven by a closed gear train that is connected through at least two force input locations with a drive or transmission train driven by a motor and extending parallel to the gear train.

In heretofore known multi-color sheet-fed rotary printing machines of this general type, force transmission is effected through the main drive shaft to the printing units or to the transfer cylinders, for the most part, at two force input locations of the closed gear train, with the aid of worm or bevel gear transmissions. The closed gear train is conducive to the exact synchronization of the printing units. Both force input locations have as their objective the attainment of a favorable load distribution. Both the closed gear train and the double force input are consequently advantageous, but necessarily produce, however, an excessively or overly defined drive.

This overdefining results in an indeterminate power flow. Without special devices, there is no assurance that, for example, when using two worm drives or transmissions, each drive will always transmit the same or a specific amount of power. Furthermore, there is no assurance that the synchronizing gears will always remain in meshing engagement with the same tooth flanks. If load deviations should occur namely at the impression cylinders or transfer cylinders, a raising of the working or operating flanks of those gears which transmit only a little or no part of the load would result. Even if the play between or backlash of the teeth is depressed to the extreme minimum, misprints or faulty printing can arise therefrom.

To avoid the change of the drive flanks of the gears in the gear train, a division of the torques into individual drive or transmission groups at a predetermined ratio or proportion with respect to one another occurs in a drive known heretofore from German Pat. No. 1,237,140, through a branching differential in the drive train. This measure alone is insufficient, however, if the power demand of the individual printing units varies in their relationship one to the other, because the power distribution effected through the differential remains constant. A change in the direction of the power flow between individual printing units is thereby possible and, consequently, a flank change with the disadvantageous consequences thereof is produced. A power flow continuously effective in one direction and present in the endangered part of the gear train can thus not be attained solely through a predetermined power branching.

It is furthermore generally known to brace overdefined drives. The elasticity of all drive or transmission members permits, during shutdown or standstill of the machine, the attainment of a definite flank layout of the synchronizing gears through suitable assembly. Due to load variations during operation and the given, non-variable rigidity of the individual drive or transmission trains, there is no assurance, however, that the definite flank layout will be maintained under all operating conditions, provided that direction and amount of the bracing or stressing are not selected so that, in the operating condition, the total power plus the reactive or idle power circulating due to the bracing or stressing is fed through only one force input location. The selected double drive consequently, at least with respect to the load distribution, has lost all of its meaning.

It is accordingly an object of the invention to provide a drive for multicolor sheet-fed rotary printing machines of the foregoing type wherein power is fed in a graduated or step-wise manner to the gear train from force input location to force input location so that, even when there is a variable power input to or absorption by the individual printing units in the entire gear train, no change of the driving flank occurs.

With the foregoing and other objects in view, there is provided in accordance with the invention, in a drive for multicolor sheet-fed rotary printing machines with tandem-mounted printing units driven by a closed gear train and including a drive motor, a drive train driven by the motor and extending parallel to the closed gear train, at least two force input locations connecting the closed gear train, to the drive train, n-1 torque limiters, wherein n is equal to the number of force input locations, being provided in the drive train, one of the force input locations being disposed in a path of direct power flow between the motor and the gear train.

In accordance with another feature of the invention, the drive train has at least two force branching locations and is constructed as a main drive shaft, one of the torque limiters being located between two adjacent force branching locations or between one of the force branching locations and an adjacent one of the force input locations, or one torque limiter is located between two adjacent force branching locations and another torque limiter is located between one of the force branching locations and a force input location adjacent thereto. Torsion rods provided in longitudinal drive or elastic couplings can be used, for example, as torque limiters with soft or yielding characteristic curve.

The disposition of such torque limiters in an inventive manner eliminates the overdefining of the drive, because the power flow can branch and can be delivered in monitored fashion to the printing units so that in the endangered part of the gear train, in all operating conditions of the machine, the power will always flow in one direction.

For example, the torque limiter can be adjusted or set so that the power delivered to the third and fourth printing unit is always smaller than the minimal power requirement. Then, a continuous power flow from the second toward the third printing unit is assured. Through suitable disposition and adjustment of the torque limiter, the power flow is capable of being reversed, namely when the power delivered to the third and the fourth printing unit is always greater than the maximal power requirement of both printing units. So-called doubling in offset printing machines that is caused by a change of tooth flank is thereby eliminated. Similarly, misalignment in book printing machines is avoided with the aid of a drive constructed in accordance with the invention.

Since the power requirement of the printing units is dependent upon the printing work, in accordance with yet another feature of the invention, adjusting means are provided for adjusting the torque limiter with respect to the maximal torque to be transmitted. The actuation of the adjusting means can be effected manually or by an automatic regulating device.

Other features which are considered as characteristic for the invention are set forth in the appended claims.

Although the invention is illustrated and described herein as drive for multicolor sheet-fed rotary printing presses with tandem-mounted printing units, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which.

Figure 1:
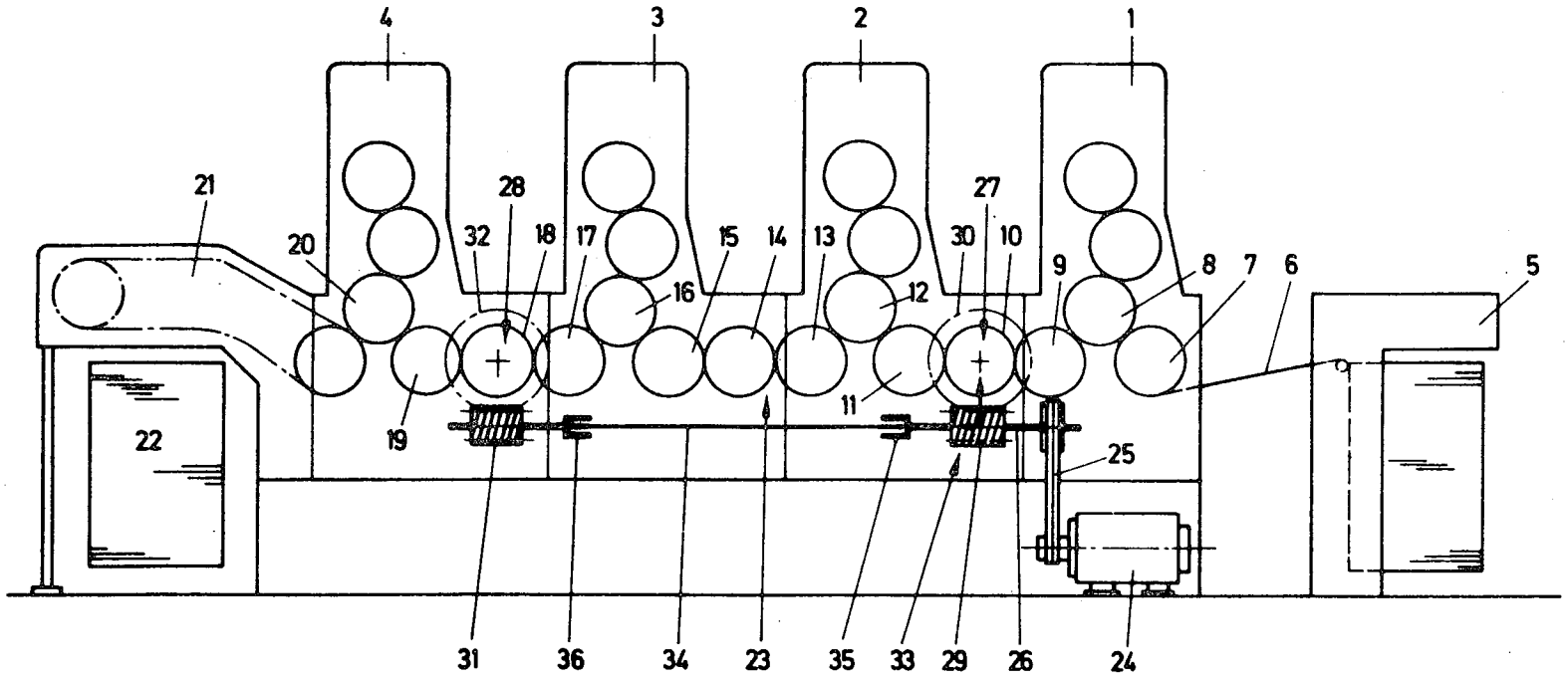
FIG. 1 is a diagrammatic view of a four-color sheet-fed rotary off-set printing machine with a torque limiter constructed as a torsion rod in the drive train.

Referring now to the drawing and first, particularly, to FIG. 1 thereof, there is shown a multicolor sheet-fed rotary printing machine having four offset printing press units 1, 2, 3 and 4. The sheet that is to be imprinted is fed from a sheet feeding device 5 over a feed table 6 and a feeding drum 7 to the impression cylinder 8 of the first printing unit 1. After the sheet is initially imprinted by the first printing unit 1, it travels over three transfer cylinders 9, 10 and 11 to the impression cylinder 12 of the record printing unit 2 where it receives a second imprint and is then conveyed further over three transfer cylinders 13, 14 and 15 to the impression cylinder 16 of the third printing unit 3. From the latter, the thus thrice imprinted sheet is fed over three transfer cylinders 17, 18 and 19 to the impression cylinder 20 of the fourth printing unit 4, receives a fourth imprint there, and is then taken over by a chain delivery device 21 and delivered to a delivery stack 22.

Although not specifically shown in FIG. 1, it is clearly known that, in a conventional manner, the shafts of all the aforementioned cylinders 7 to 20 respectively carry a spur gear suitably secured thereon, at the drive side of the printing machine, the spur gears having a diameter corresponding to that of the cylinders 7 to 20 and forming a gear train 23 i.e. all of the spur gears meshing one with another and consequently assuring, in addition to the drive, the synchronization of the four printing units 1 to 4 as well.

The power consumed by the four individual printing assemblies or units of the machine is introduced by a motor 24 which, by means of a belt drive 25, drives a transmission or gear train extending parallel to the gear train 23. At two locations of the gear train 23, force input locations 27 and 28 are provided, namely at the transfer cylinders 10 and 18. The power is fed from the main drive shaft 26 to the gear train 23 over two worm transmissions 29, 30 and 31, 32. The first mentioned worm transmission, formed of the worm 29 and the worm gear 30, represents a force branching location 33. Part of the power delivered by the motor 24 is applied through the worm gear 30 to the gear train 23, while the remainder of the power is supplied by the main drive shaft 26 to the second worm drive 31, 32. The main drive shaft 26 is partly formed of a torsion rod 34 between the two worm transmissions 29, 30 and 31, 32. The ends of the torsion rod are formed as part of the respective couplings 35 and 36 and are in engagement with the components of the main drive shaft 26 so as to be secured for rotation therewith yet displaceable or slideable relative thereto.

The torsion rod 34 acts as a torque limiter with soft or yielding characteristic curve and is connected to the force branching location behind the latter in direction from the first printing unit 1 toward the fourth printing unit 4. Thereby, only power of a value with an upper limit determined by the torque limiter can be fed to the force input locations 28 over the worm transmission 31, 32. The maximally transmittable moment of the torsion rod 34 is set so that in all operating conditions of the described four-color sheet-fed rotary printing machine, power flow from printing unit 2 toward printing unit 3 is always assured. An exchange of the driving flanks in the critical range of the gear train 23, namely for the three gears of the transfer cylinder 13, 14 and 15 is completely eliminated or excluded.

Figure 2:
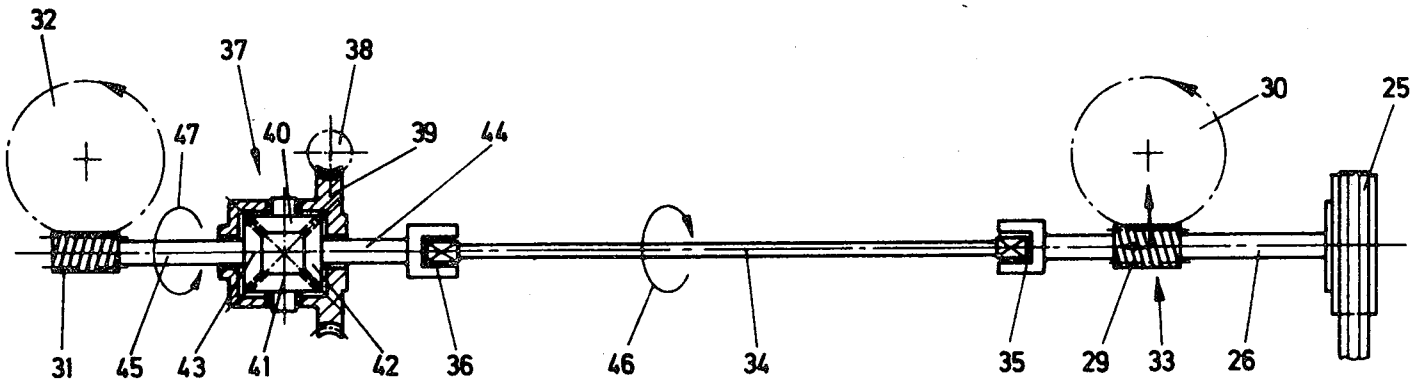
FIG. 2 is an enlarged diagrammatic view of the torque limiter of FIG. 1 provided with an adjusting device.

In FIG. 2, there is shown a drive or transmission train of a machine similar to that in FIG. 1. In this regard, it is immaterial whether the drive or transmission train is for a multi-color sheet-fed rotary offset printing machine or for a multi-color sheet-fed rotary high-speed printing machine. In the embodiment of the invention shown in FIG. 2, the main drive shaft 26 is also driven through a belt drive 25. The force input into the non-illustrated gear train is effected over the worm transmission 29, 30 and over the additional worm transmission 31, 32. Behind the force branching station 33, as viewed in direction from the right-hand toward the left-hand side of FIG. 2, the main drive shaft 26, once again, is formed partly of the torsion rod 34. Deviating from the hereinbefore described embodiment of the drive or transmission train, between the coupling 36 and worm gear 31 of the embodiment of FIG. 2, there is provided an adjustment device 37 for adjusting the maximal torque to be transmitted by the torsion spring or rod 34.

The adjustment device 37 is constructed as a differential transmission or gearing system. It is provided with an adjusting wrom 38 which meshes with a worm gear 39. The worm gear 39 is doubly mounted on the main drive shaft and carried both differential bevel gears 40 and 41 which mesh, on the one hand, with the sun drive gear 42 and, on the other hand, with the sun driven gear 43. The sun drive gear 42 is secured to the one end of the main drive shaft section 44, the other end of which is formed by the coupling 36. The sun driven gear 43 is mounted at one end of the main drive shaft section 45 which carries the worm 31 at the other end thereof.

Since the adjustment device 37 constructed as differential gearing or transmission changes the rotary direction of the main drive shaft, which is indicated by the curved arrow 46, into the rotary direction represented by the curved arrow 47, the thread direction of the worm 31 is opposite that of the worm 29 so that both worm gears 30 and 32 have the same rotary sense.

By actuating the adjusting worm 38, the sun drive gear 42 is twisted or turned relative to the sun driven gear 43 because of the differential gearing, and the torsion rod 34 is thereby twisted or subjected to torsion. In accordance with the adjusted prestress of the torsion rod 34, a larger or smaller maximal torque or twisting moment may be transmitted to the worm transmission 31, 32. In order to facilitate the adjustment of the required maximal torque by the servicing personnel, a scale from which the adjusted maximal torque is readable can be provided in connection with a non-illustrated handwheel for actuating the adjusting worm 38.

The adjustment of the maximal torque of the torsion spring or rod 34, that acts as torque limiter, can also be effected in a simpler manner. It is conceivable, for example, to replace the adjustment device 37 by a relatively simple flange coupling. Both flanges of the coupling could be released from one another during shutdown or standstill of the machine and could be twisted or turned relative to one another. Also, this twisting or turning effects a change in the maximal torque of the torsion rod 34 that is to be transmitted. The advantage the described adjustment device 37 with respect to a simple flange coupling, is that adjustment to the desired maximal torque can be made during the operation of the machine.

Besides the described torsion rods 34, which have a soft or yielding characteristic curve, soft or yielding couplings can find utility as torque limiters in the sense of the invention of the instant application.

Figure 4:
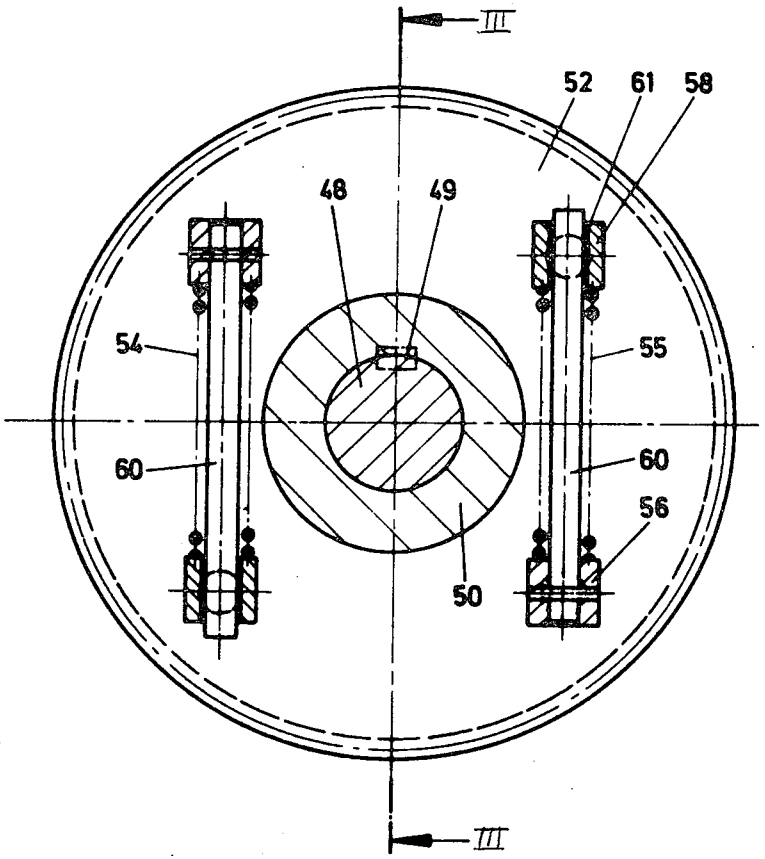
FIG. 4 is a cross-sectional view of FIG. 3 taken along the line IV—IV in the direction of the arrows.
Figure 3:
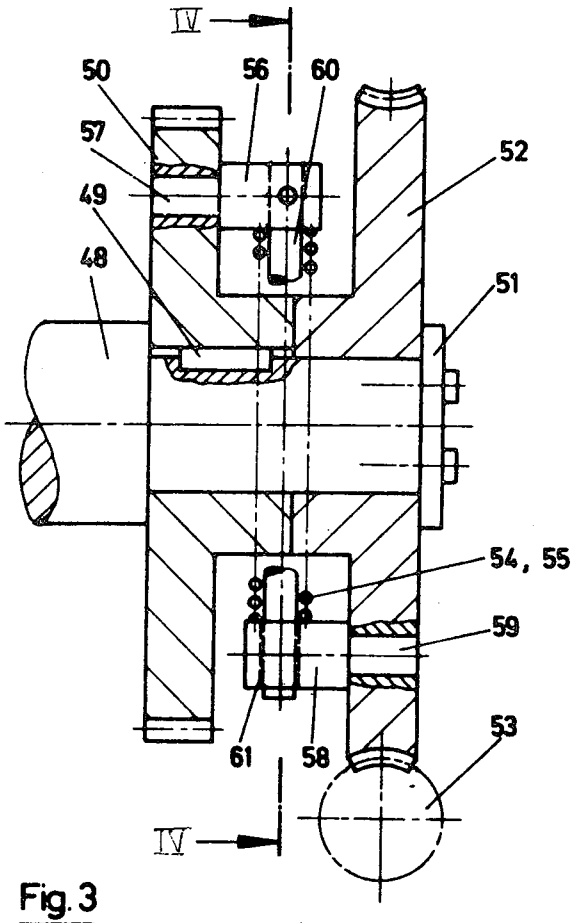
FIG. 3 is a much enlarged longitudinal sectional view, partly diagrammatic, of another embodiment of the torque limiter constructed as a yielding or soft coupling.

FIGS. 3 and 4 show such a soft or yielding coupling at a force input location. By means of a key 49, a spur gear 50 is keyed to the shaft 48. The cylinder carried by the shaft 48 is not shown in FIGS. 3 and 4. A worm gear 52 is loosely rotatably mounted on the free end of the shaft 48 between the spur gear 50 and a guide disc 51. The drive is effected by a worm 53, shown in phantom, which is located on the non-illustrated main drive shaft of the machine. Respective compression springs 54 and 55 are mounted opposite one another diametrically on both sides of the shaft 48 and between the spur gear 50 and the worm gear 52. The one end of the compression spring 54 rests on a step bearing or spindle bracket 56 which is mounted by means of a pin 57 in the spur gear 50, while the other end of the compression spring 54 engages a counterbearing or abutment member 58 which is mounted by a pin 59 in the worm gear 52. A guide rod 60, which extends through a bore 61 into the counterbearing or abutment member 58 and thus guides the compression spring 54, is pinned in the step bearing 56.

The compression spring 55 is mounted in a corresponding manner. The step bearing 56 is also disposed on the spur gear 50, and the counterbearing or abutment member 58 on the worm gear 52.

Assuming that the soft or yielding coupling according to the embodiment of FIGS. 3 and 4 were provided in the force input location 27 of a multi-color sheet-fed rotary offset printing machine according to FIG. 1, the transfer cylinder 10 would be disposed on the shaft 48. In such a case, the torsion rod 34 would naturally have been dispensed with or eliminated, because only a predetermined torque can be maximally transmitted at the force input location 27 which is located behind the force branching location 33. It would thus be possible to limit this torque so that power would flow continuously from the printing unit 3 toward the printing unit 2, so that no fear would exist of the lifting of the driving flanks in the case of the endangered cylinders 13, 14 and 15. The soft or yielding coupling according to FIGS. 3 and 4 can be directly mounted on the main drive shaft 26 in place of the torsion rod 34 besides being mounted directly at the force input location.

The embodiments of a transmission train for multicolor sheet-fed rotary printing machine shown in FIGS. 1 and 2 exhibit only two force input locations. In these embodiments, therefore, only one torque limiter is required. Naturally, a greater number of force input locations can also be provided. In such a case, a greater number of force branching locations are then necessarily required. In order to achieve the same effect as for the embodiment shown in FIG. 1 i.e. in order to ensure the engagement of all of the driving flanks of the entire gear train, it is then necessary to serially connect n-1 torque limiters to n force input locations, the torque limiters having to be graduated so that a power flow in a predetermined direction is assured for all operating conditions.

I claim:

1. In a drive for a multicolor sheet-fed rotary printing machine with tandem-mounted printing units driven by a closed gear train and including a drive motor, a drive train driven by the motor and extending parallel to the closed gear train, at least two force input locations connecting the closed gear train to said drive train, said drive train comprising n-1 torque limiters for limiting the amount of torque applied respectively at said input locations, wherein n is equal to the number of force input locations being provided in said drive train, one of said force input locations being disposed in a path of direct power flow between the motor and the gear train, a respective torque limiter being located between the respective force input locations and having soft transmission means for yieldably transmitting a moment up to a given maximum to said closed gear train at the other of said force input locations, the printing machine being of the four-color type and said drive train being constructed as a main drive shaft and including a first and a second worm transmission, said gear train including a first gear on an intermediate transfer cylinder located between a first and a second printing unit of the printing machine, and a second gear on an intermediate transfer cylinder located between a third and a fourth printing unit of the printing machine, said main drive shaft being connected through said first worm transmission to said first gear, and through said second worm transmission to said second gear, said soft transmission means forming part of said main drive shaft and being constructed at least partly as a torsion rod between said first and second worm transmissions.

2. Drive according to claim 1 wherein said torsion rod is constructed as part of a coupling at both ends thereof, and wherein an adjusting device in the form of a differential transmission is connected between one of said couplings and the worm transmission adjacent thereto.

* * * * *